United States Patent [19]

Poehlmann

[11] Patent Number: 4,893,409

[45] Date of Patent: Jan. 16, 1990

[54] FOLDING PERSONAL KNIFE

[76] Inventor: Paul W. Poehlmann, 6480 Panoramic Hwy., Stinson Beach, Calif. 94970

[21] Appl. No.: 104,939

[22] Filed: Oct. 6, 1987

[51] Int. Cl.[4] ..... B26B 3/06

[52] U.S. Cl. ..... 30/161; 30/155

[58] Field of Search ..... 30/155, 156, 160, 161

[56] References Cited

U.S. PATENT DOCUMENTS

| | | | |
|---|---|---|---|
| 2,199,430 | 5/1940 | Greve | 30/160 |
| 4,604,803 | 8/1986 | Sawby | 30/161 |
| 4,670,984 | 6/1987 | Rickard | 30/161 |

FOREIGN PATENT DOCUMENTS

| | | | |
|---|---|---|---|
| 1248117 | 10/1960 | France | 30/161 |

*Primary Examiner*—Frank T. Yost
*Assistant Examiner*—Willmon Fridie, Jr.
*Attorney, Agent, or Firm*—Lothrop & West

[57] ABSTRACT

The frame of a personal, folding knife forms a compartment for receiving a knife blade having a hub pivoted to turn on the frame about an axis spanning the compartment. A locking block is manually slidable on the frame. A spring urges the lock block toward engagement in a notch in the blade hub.

2 Claims, 4 Drawing Sheets

FOLDING PERSONAL KNIFE

BACKGROUND OF THE INVENTION

1. Field Of The Invention.

The invention is concerned with cutlery and particularly with folding hand knives for personal use.

2. Description Of The Related Art.

The applicant, although for years having been involved in making and selling personal, hand knives, has no knowledge of any art related to the embodiments of his invention that are included in the accompanying claims.

SUMMARY OF THE INVENTION

A folding, personal knife has a frame defining a compartment spanned near one end by a pivot pin about the axis of which the hub of a knife blade rotates. The blade is lockable in at least one rotated position by a lock block slidable on the frame. A spring urges the lock block into a position in a notch in the blade hub. The lock block can be moved out of the notch manually.

DESCRIPTION OF THE PREFERRED EMBODIMENTS

Figure 1:
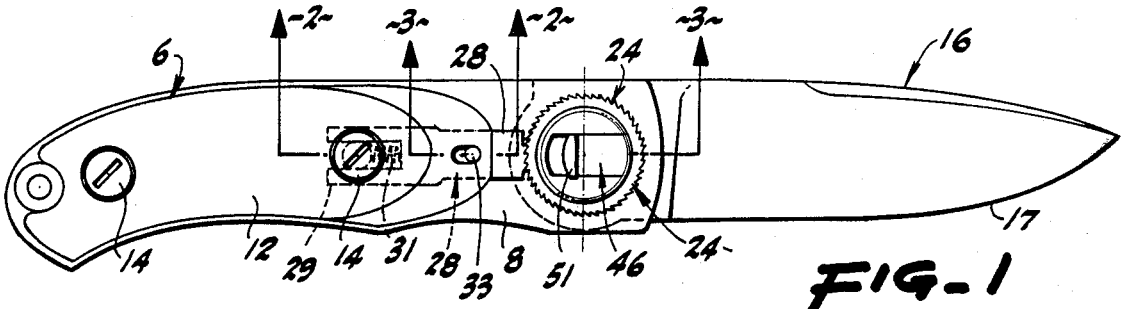
FIG. 1 is a side elevation of one form of the knife in open position.

The present arrangement is especially concerned with a folding personal knife that is easily carried in folded position but is also easily extended to open position, in one version, without the user having to grasp the blade. Rather, the user operates a pivoting mechanism which swings the blade into and out of its extended or folded positions, the blade being securely fixed when in those extreme positions.

In the first form of the structure particularly shown in FIGS. 1 through 6, there is afforded a frame 6 made up of a pair of generally planar, contoured side plates 7 and 8 lying on opposite sides of an intermediate spacer plate 9 somewhat similarly contoured and together with the side plates forming an intermediate compartment 11. Conveniently, one of the side plates 7 is provided with a hand grip 12, and the other side plate 8 is provided with a hand grip 13, the hand grips being detachably secured in position by appropriate screw fasteners 14.

Arranged to cooperate with the frame 6 and to be received in the compartment 11 is a blade 16 having an outline configuration compatible with that of the side plates and having a sharpened blade edge 17. The blade includes a blade hub 18 in which there is provided a through opening 19 affording a journal surface in the hub 18.

Figure 2:
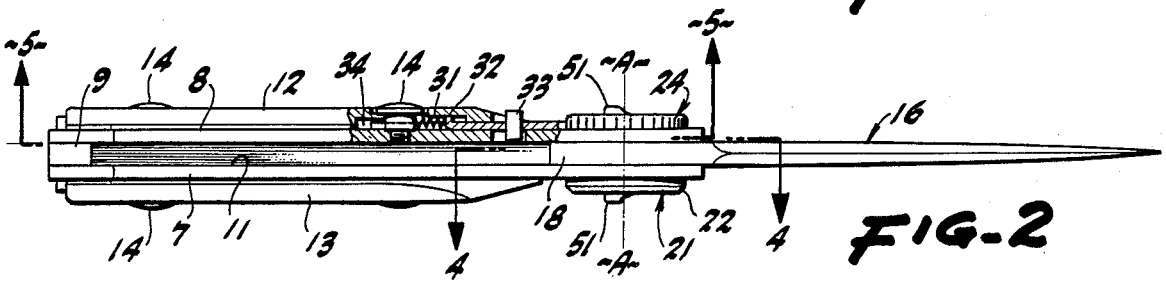
FIG. 2 is a view of the knife of FIG. 1 taken from below looking upwardly, a portion being in section on the line 2—2 of FIG. 1.
Figure 3:
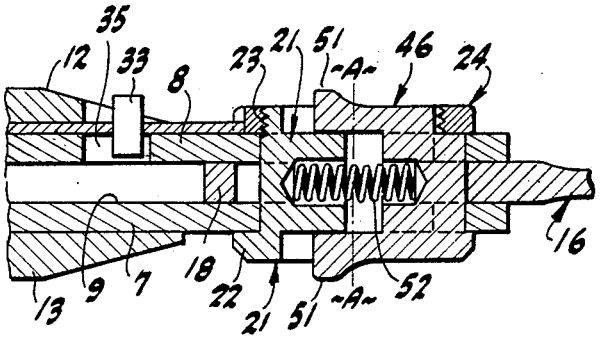
FIG. 3 is a detail in enlarged cross-section, portions being broken away, and the plane of section being indicated by the line 3—3 of FIG. 1.
Figure 4:
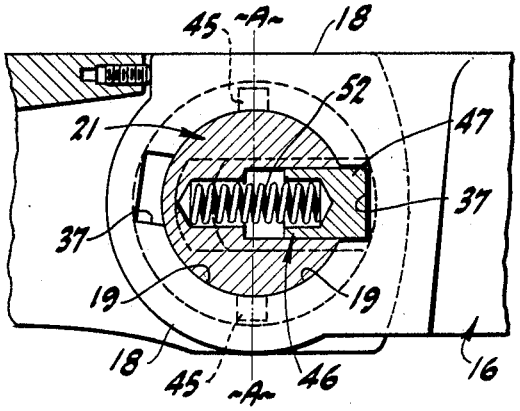
FIG. 4 is a detail enlargement in cross-section, the plane of which is indicated by the line 4—4 of FIG. 2.

Arranged to cooperate with the journal surface is a pivot pin 21 at one end enlarged to afford a pivot pin flange 22 designed to overlie the adjacent side plate 8. At the other end, the pivot pin 21 is formed with pivot pin threads 23 receiving a pawl ring 24 or threaded nut for holding the pivot pin 21 axially in position. To make sure that the nut or ring 24 is held in the appropriately tightened position, the exterior of that ring is serrated by numerous external teeth 27 into which, in virtually any rotated position of the ring, extend appropriate teeth at the end of a detent slide 28. This slide is guided on the adjacent side plate 7 by a detent fork 29 embracing and slidable with respect to the shank of one of the fasteners 14. The slide 28 is urged in one direction by a detent spring 31 interposed between an upturned detent wall 32 and the particular fastener 14. The spring is situated in a detent slot 34. Guiding the slide 28 is a pin 33 disposed in the slot 34. The end of the detent closest to the pivot pin 21 carries a number of detent teeth 36 interengageable with adjacent ones of the comparable teeth 27 on the pawl ring 24. When the detent slide 28 is subject only to the urgency of the spring 31, the detent teeth 36 in engagement with those of the detent pawl ring 24 prevent any rotation of the pawl ring 24 with respect to the frame 6 about a rotational axis A—A (FIG. 2).

Figure 6:
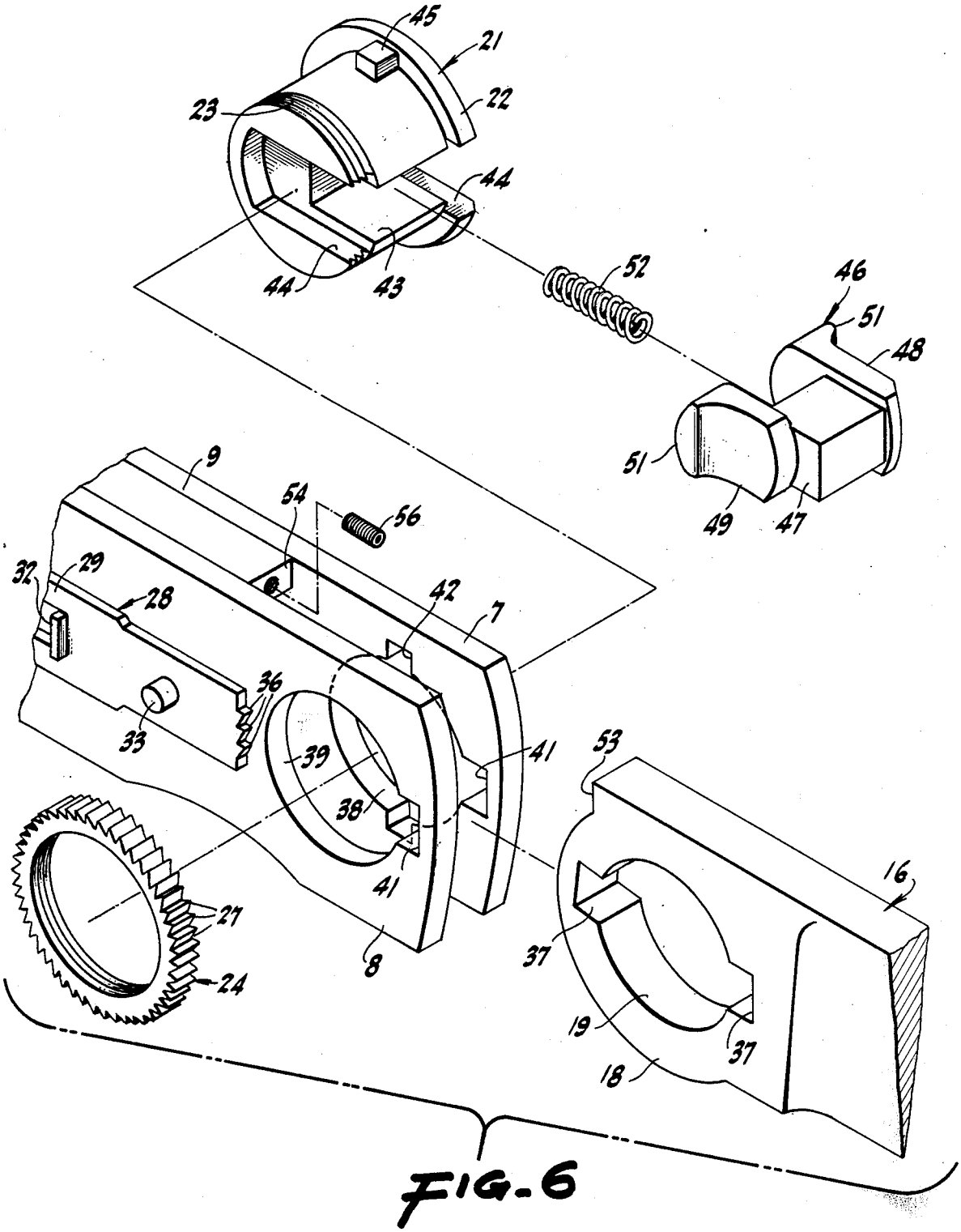
FIG. 6 is an exploded view showing various components of the knife arranged approximately in the relationship of their assembly.
Figure 7:
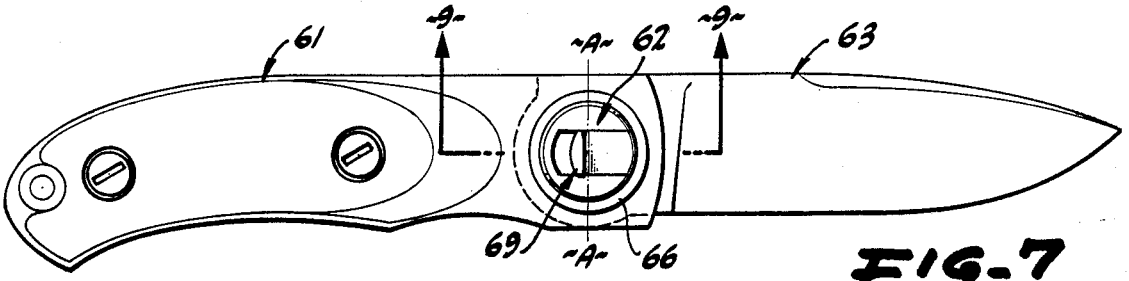
FIG. 7 is a side elevation of a modified form of knife shown in open position.
Figure 8:
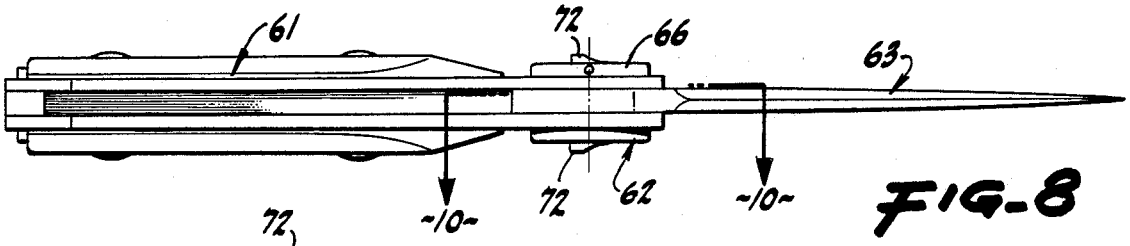
FIG. 8 is a view from below of the knife of FIG. 7.
Figure 9:
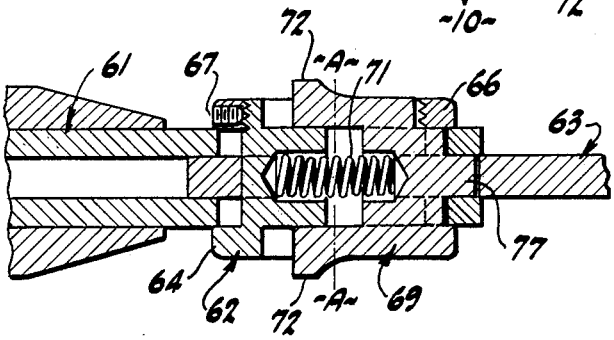
FIG. 9 is a cross-section in detail, the plane of which is indicated by the line 9—9 of FIG. 7.
Figure 10:
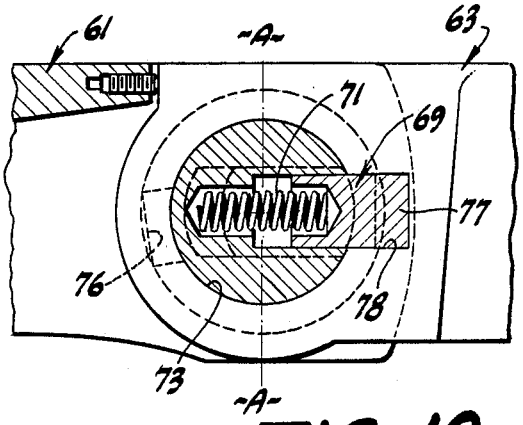
FIG. 10 is a cross-section, the plane of which is indicated by the line 10—10 of FIG. 8.
Figure 11:
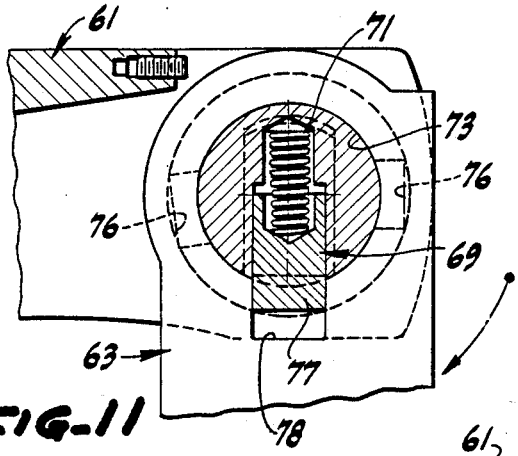
FIG. 11 is a cross-section with parts broken away, the plane of section being indicated by the line 10—10 of FIG. 8 but showing the blade in a partially open position.
Figure 12:
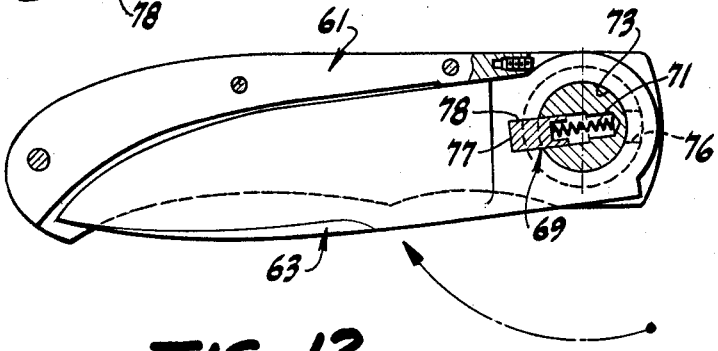
FIG. 12 is a view of the knife of FIG. 7 in cross-section, comparable to the showing in FIG. 5.
Figure 13:
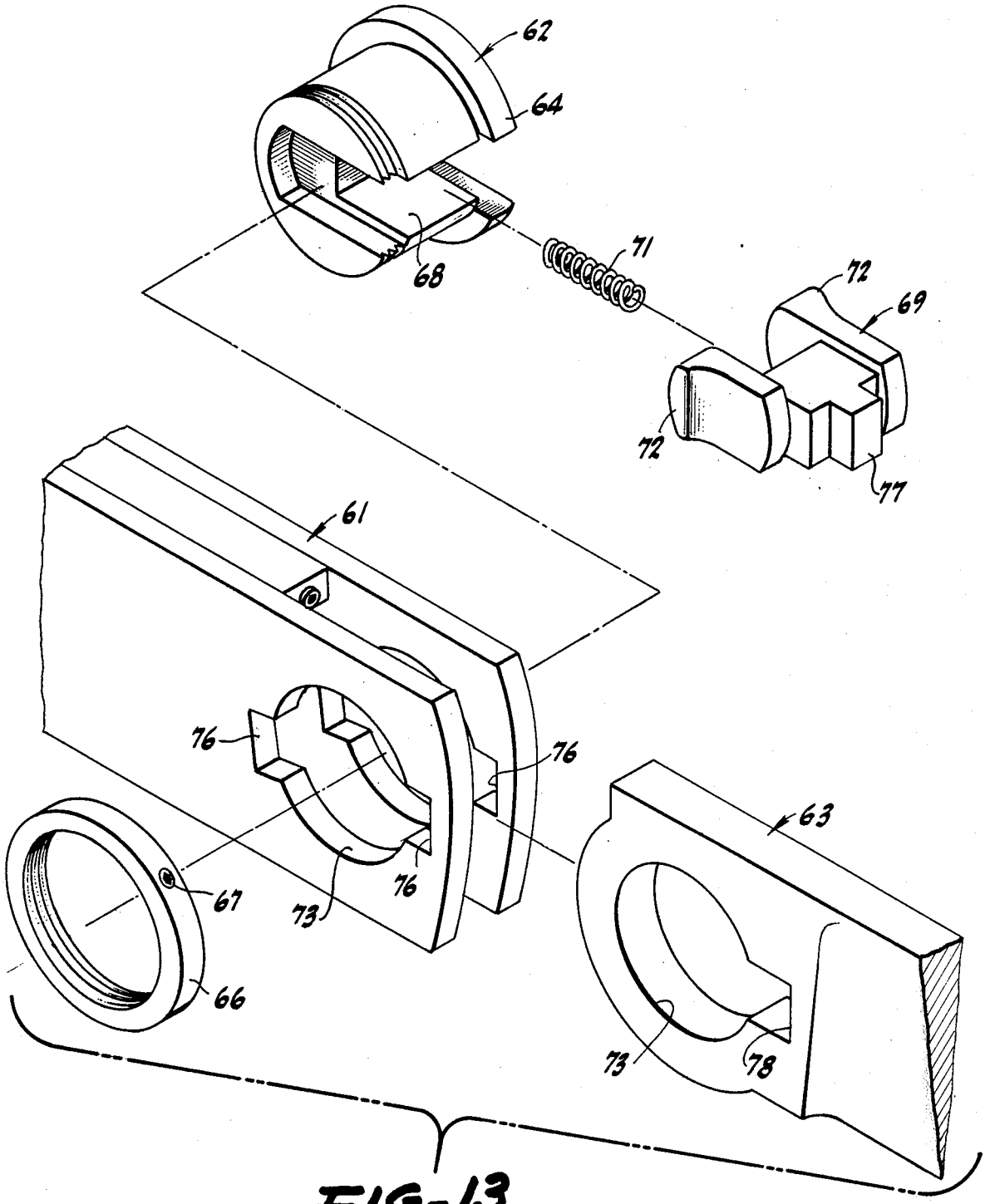
FIG. 13 is an exploded view in isometric perspective of various parts of the knife in their relationships for assembly and with parts broken away.

As particularly shown in FIG. 6, the blade is provided with blade opening slots 37 enlarging the blade opening 19 in a symmetrical fashion and usually on or close to a diameter. Generally to correspond with the opening 19 in the blade, there is provided a plate opening 38 in the plate 7 and a transversely aligned corresponding plate opening 39 in the plate 8. Each of the plates has a single slot 41 merging with the respective one of the plate openings 38 and 39 and corresponding in configuration to the blade opening slots 37. A single, smaller lug recess 42 is provided in the plate 7 and opens into the plate opening 38, for a purpose later described.

In the pivot pin 21, there is cut a primary slot 43 extending inwardly from one surface of the pin for about half of the pivot pin diameter, the surfaces of the slot defining a generally rectangular opening extending between a pair of secondary slots 44 at the opposite ends of the pivot pin 21. These secondary slots 44 are substantially U-shaped in end elevation, and are greater in lateral and longitudinal extent than the primary slot 43 while opening therewith at the ends thereof. Projecting from the pivot pin flange 22 and from the cylindrical surface of the pivot pin itself is a lug 45 of a configuration to be received snugly in the lug recess 42. That occurs when the pivot pin 21 is inserted into the openings 38 and 39 of the side plates and prevents relative rotation therebetween.

Prior to the insertion of the pivot pin into the frame, the primary and secondary slots 43 and 44 of the pin 21 receive a slide 46. This slide includes a central, generally rectilinear lock block 47 of dimensions to be slidably received in and entirely withdrawn from the central portion of the primary slot 43.

The slide 46 also includes a finger operator 48 of substantial length merging with one side of the lock block 47 and is also provided with a finger operator 49 of somewhat shorter dimension merging with the other side of the lock block 47. The finger operators 48 and 49 are both provided with operating flanges 51 so that the block 47 can be moved longitudinally against the force of a block spring 52 interposed between the lock block itself and against the wall at the end of the primary slot 43 in the pivot pin 21. The spring 52 urges the lock block 47 in a direction out of the primary slot 43.

The blade 16 at one end is not entirely circular about its rotational axis A—A. The blade has a transverse portion in the nature of an abutting wall 53 designed to approach a similar transverse wall 54 at the end of the spacer plate 9. The spacer plate has an opening in this wall tapped to receive a set screw 56. This screw serves to abut the wall 53 and can be adjusted, preferably by an Allen wrench, precisely to establish the exact or extreme open position of the blade 16 in the frame 6.

Figure 5:
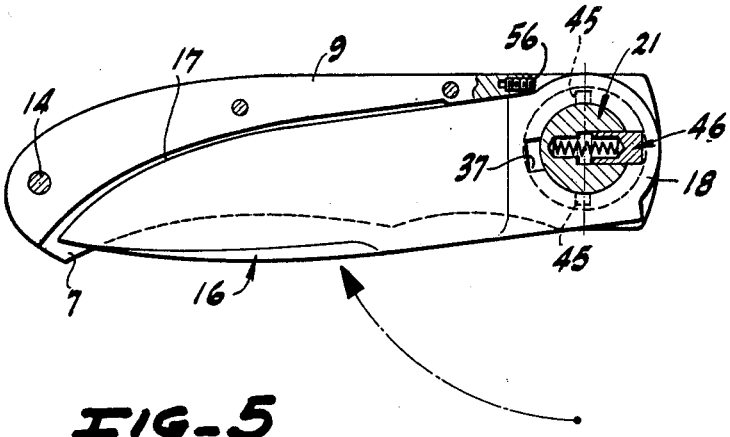
FIG. 5 is a view in cross-section of the knife in folded position, the plane of section being indicated by the line 5—5 of FIG. 2.

With this group of parts in assembled relationship, and with the knife folded as it often is, as shown in FIG. 5, the lock block 47 occupies both of the plate opening slots 41 as well as a particular one of the knife slots or blade opening slots 37. That holds the parts rigid in a keyed, closed relationship.

In order to change that relationship, the user, preferably using his thumb and forefinger and holding the knife handle in the palm of one or of his other hand, grasps or abuts the operating flanges 51. By relatively retracting the flanges against the urgency of the spring 52, he withdraws the lock block 47 entirely from engagement with the engaged one of the blade opening slots 37. This frees the knife blade 16 to be independently rotated and to be rotated by the user's thumb and forefinger in the plate journal openings 38 and 39. The user makes such a rotation of the knife blade for approximately one-half turn until the knife blade 16 is stopped and fully extended, as shown in FIG. 1. At that juncture the user releases the operating flanges 51. The spring 52 then urges the lock block 47 to project into the then-adjacent one of the blade opening slots 37. The lock block 47 then not only occupies that slot 37, but also occupies both of the slots 41. This locks the blade with respect to the frame 6 in its open or extended position as shown in FIGS. 1 and 2. A reverse sequence of operations by the user rotates the blade from its open position back to its closed position as shown in FIG. 5. In that position, the lock block 47 is again spring-forced into the openings 41 and into the adjacent opening slot 37 and the folded knife is securely held in closed and safe position.

In the second version of the folding knife, as shown particularly in FIGS. 7 through 13, many of the parts are virtually identical with those in the first version of FIGS. 1 through 6, and the reference numbers apply to them also. The general functions of the two versions are comparable, but while in the first version relative rotation between the blade itself and the frame can be accomplished by manually grasping and rotating the blade around the pivot pin fixed in the frame, in the second version the pivot pin is always connected to the blade, although they both can be turned together as a unit relative to the frame. The blade can be grasped and pulled to rotate out from the frame or can be manually pushed into position in the frame accompanied by rotation of the pivot pin itself. Also, the pivot pin can be grasped and rotated accompanied by rotation of the blade relative to the frame. The blade and pivot pin can still be locked in both extreme closed or extreme open positions.

In the second version, the frame 61 is pierced along the axis A—A to provide a journal for a pivot pin 62 on which a blade 63 is also mounted. At one end the pivot pin is formed with a restraining flange 64, while at the other end the pivot pin is threaded and receives a ring nut 66 held in adjusted position by a set screw 67. Unless otherwise restrained, the pivot pin 62 is free to rotate relative to the frame without limit about the axis A—A.

The pivot pin 62 is formed with a radial notch 68 having wide end portions and a narrower central portion to receive a lock block 69 for radial motion but without axial motion. A spring 71 urges the lock block 69 in a direction out of the notch 68, and manual lugs 72 afford a grip for the user to manipulate the lock block against the spring 71 and for rotation of the pivot pin. When unrestrained manually, the lock block 69 is pressed by the spring 71 against the surface of a bore 73 through the frame 61 and when in properly rotated position is also pressed into the adjacent pair of two pairs of notches 76 in the side plates of the frame 61. In this version, the lock block 69 is especially provided with a centrally disposed projection 77 extending beyond the remainder of the block 69. The blade 63 is also especially formed with a deep notch 78 opening into the bore 73 and arranged to receive the central projection 77, the dimensions being such that while the lock block side portions can be entirely retracted from the relatively shallow notches 76, the longer central projection 77 never is entirely retracted from the notch 78.

In this version and by reason of the permanent sliding connection of the projection 77 and the lock block 69 and the pivot pin 62, the blade and the pivot pin always rotate in unison. The blade can, when released, be freely swung between its two extreme end positions and, when in either extreme position, can be firmly locked in place.

I claim:

1. A folding personal knife comprising a frame having a compartment, a pivot pin having an axis, said pin engaging said frame and spanning said compartment, a knife blade receivable in said compartment and mounted to rotate about said pivot pin axis relative to said frame, means manually slidable relative to said frame and into engagement with said blade for holding said blade against rotation about said axis relative to said frame, said means including threads on said pivot pin, a nut threadedly engaging said threads on said pivot pin, and means for inhibiting relative rotation of said pivot pin and said nut relative to said frame.

2. A folding personal knife comprising a frame having a compartment, a pivot pin having an axis, said pin engaging said frame and spanning said compartment, a knife blade receivable in said compartment and mounted to rotate about said pivot pin axis relative to said frame, means manually slidable relative to said frame and into engagement with said blade for holding said blade against rotation about said axis relative to said frame, said means including a threaded pivot pin, a nut threadedly engaging said pivot pin, a slide, means for mounting said slide on said frame for sliding movement toward and away from said nut, and interengageable means on said slide and said nut for inhibiting rotation of said nut relative to said frame.

* * * * *